US008631673B2

(12) United States Patent
Rosochowski

(10) Patent No.: US 8,631,673 B2
(45) Date of Patent: Jan. 21, 2014

(54) SEVERE PLASTIC DEFORMATION OF METALS

(75) Inventor: Andrzej Rosochowski, Glasgow (GB)

(73) Assignee: University of Strathclyde, Glasgow (GB)

( * ) Notice: Subject to any disclaimer, the term of this patent is extended or adjusted under 35 U.S.C. 154(b) by 1415 days.

(21) Appl. No.: 11/909,233

(22) PCT Filed: Mar. 21, 2006

(86) PCT No.: PCT/GB2006/000986

§ 371 (c)(1), (2), (4) Date: Jan. 29, 2008

(87) PCT Pub. No.: WO2006/100448

PCT Pub. Date: Sep. 28, 2006

(65) Prior Publication Data

US 2009/0126444 A1 May 21, 2009

(30) Foreign Application Priority Data

Mar. 24, 2005 (GB) ..... 0506091.8

(51) Int. Cl.
*B21C 23/21* (2006.01)
*B21C 23/00* (2006.01)

(52) U.S. Cl.
USPC ..... 72/263; 72/253.1

(58) Field of Classification Search
USPC ..... 72/253.1, 262, 353.2, 354.2, 256, 257, 72/259, 260, 261, 263, 273.5, 304, 305, 72/308, 352
See application file for complete search history.

(56) References Cited

U.S. PATENT DOCUMENTS

| | | | | |
|---|---|---|---|---|
| 3,286,502 | A * | 11/1966 | Cogan | 72/259 |
| 4,028,919 | A * | 6/1977 | Austen | 72/56 |
| 5,400,633 | A | 3/1995 | Segal et al. | |
| 5,513,512 | A | 5/1996 | Segal | |
| 5,600,989 | A | 2/1997 | Segal et al. | |
| 5,850,755 | A | 12/1998 | Segal | |
| 5,904,062 | A | 5/1999 | Semiatin et al. | |
| 6,029,487 | A * | 2/2000 | Genin et al. | 72/58 |
| 6,197,129 | B1 | 3/2001 | Zhu et al. | |
| 2007/0131013 | A1* | 6/2007 | Segal | 72/253.1 |

FOREIGN PATENT DOCUMENTS

| | | |
|---|---|---|
| FR | 2220328 | 10/1974 |
| JP | 02251330 | 10/1990 |
| JP | 03254341 | 11/1991 |
| SU | 812401 | 3/1981 |
| SU | 902962 | 2/1982 |
| SU | 1140870 | 2/1985 |

OTHER PUBLICATIONS

International Search Report for International Appl. No. PCT/GB2006/000986.

(Continued)

*Primary Examiner* — Debra Sullivan
(74) *Attorney, Agent, or Firm* — Alston & Bird LLP

(57) ABSTRACT

A method of treating a metal billet to change its mechanical and/or physical properties by reducing grain size, the method involving feeding the billet through a first passage and into a second passage inclined to the first passage and deforming the billet by repeatedly loading and unloading it using a reciprocating die at a junction between the first and second passages.

21 Claims, 8 Drawing Sheets

(56) References Cited

OTHER PUBLICATIONS

Y. Saito, H. Utsunomiya and H. Suzuki; *Proposal of Novel Continuous High Straining Process—Development of Conshearing Process*; Advanced Technology of Plasticity; Proceedings of the 6$^{th}$ ICTP; Sep. 19-24, 1999; pp. 2459-2464; vol. III.

Jae-Chul Lee, Hyun-Kwang Seok, Jun-Hyun Han and Young-Hoon Chung; *Controlling the Textures of the Metal Strips via the Continuous Confined Strip Shearing (C2S2) Process*; Materials Research Bulletin 36; 2001; pp. 997-1004; Elsevier Science Ltd.

Georgy J. Raab, Ruslan Z. Valiev, Terry C. Lowe and Yuntian T. Zhu; *Continuous Processing of Ultrafine Grained A1 by ECAP-Conform*; Materials Science and Engineering A 382; 2004; pp. 30-34; Elsevier B.V.

A.B. Suriadi and P.F. Thomson; *Control of Deformation History for Homogenizing and Optimizing Mechanical Properties of Metals*; pp. 920-925.

Y. Saito, N. Tsuji, H. Utsunomiya, T. Sakai and R.G. Hong; *Ultra-Fine Grained Bulk Aluminum Produced by Accumulative Roll-Bonding (ARB) Process*; Scripta Materialia; 1998; pp. 1221-1227; vol. 39, No. 9; Elsevier Science Ltd.

* cited by examiner

Schematics of ECAP and FEM results of strain distribution

SEVERE PLASTIC DEFORMATION OF METALS

BACKGROUND OF THE INVENTION

1. Field of the Invention

The present invention relates to a process for causing continuous severe plastic deformation of metals, and in particular for creating nanostructured metals.

2. Description of Related Art

Bulk nanostructured metals (nanometals) attract substantial attention due to their unique mechanical and physical properties. For example, at low temperatures, an ultra fine grain size (<1 μm) doubles the strength and toughness of the material and, at high temperatures, it leads to superplastic behaviour at the strain rate which is one order higher than for traditional superplastic materials. The preferred method of producing bulk nanometals, which avoids health issues associated with nanopowders, is severe plastic deformation (SPD). In this, a very large plastic deformation (true strain 3-10 depending on the material) subdivides the coarse grain structure of all types of metals into sub-micron and nano grain structure. SPD processes are different from traditional metal forming processes by their ability to retain the shape of the workpiece.

There are two groups of SPD processes—batch and continuous processes. Batch processes deal with relatively short billets with a limited length to width ratio (about 6). They are usually used for laboratory purposes to produce samples for further tests. The most popular batch process is Equal Channel Angular Pressing (ECAP) also known as Equal Channel Angular Extrusion (ECAE). Examples of this are described in U.S. Pat. No. 5,400,633, U.S. Pat. No. 5,513,512, U.S. Pat. No. 5,600,989, U.S. Pat. No. 5,850,755, and U.S. Pat. No. 5,904,062. In this process, a rectangular or cylindrical bar is pushed from one section of a constant profile channel to another section orientated at an angle ≥90° to the first one, as shown in FIG. 1. Plastic deformation of the material is caused by simple shear in a thin layer at the crossing plane of the channel sections. However, a problem with this technique is that the ideal mode of deformation shown in FIG. 1 cannot be achieved in practice because of end effects and non-uniform strain distribution across the channel. Another problem is that the length of the leading channel limits the length of the billet. It must not be too long to avoid an excessive force caused by friction and the associated tool design problems.

There will be cases when a batch process is technically justified and economically viable. However, for high volume production of variety of nanostructured metals a continuous process would be much more valuable to industry. Such a process could be a real breakthrough and allow production and implementation of nanostructured metals on a large scale.

Various continuous SPD processes have been proposed. Some of these are derived from the so-called Conform process. This is described by Y. Saito, H. Utsunomiya, H. Suzuki: in M. Geiger (Ed), Advanced Technology of Plasticity, Springer, 1999, Vol. III, pp. 2459-2464; J. C. Lee, H. K. Seok, J. H. Han, Y. H. Chung, Mater. Res. Bull. 36 (2001), 997-1004 and G. J. Raab, R. Z. Valiev, T. C. Lowe and Y. T. Zhu, Mater. Sci. Eng. A328 (2004), 30-34. The original Conform process was not intended for nanostructuring. This is a continuous lateral extrusion process with the material led to the extrusion chamber by a grooved wheel and constrained by an abutment, as shown in FIG. 2. Due to intensive deformation and friction in the leading channel, the material reaches the chamber hot enough to be easily extruded. However, a significant problem with SPD processes based on Conform is that the force required to extrude the material is relatively high. Since feeding of the workpiece is based on friction, this leads to heating up of the material. Whilst this is a virtue in the original Conform process, because high temperature leads to grain growth, it is a potential problem in an SPD process.

Equal Channel Angular Drawing (ECAD) is another proposed continuous SPD process. This is described by A. B. Suriadi and P. F. Thomson in Proc. of Australasia-Pacific Forum on Intelligent Processing & Manufacturing of Materials, IPMM, 1997, pp. 920-926. In this, the workpiece is pulled through a die, as shown in FIG. 3. The pulling force in ECAD is limited by fracture of the drawn workpiece. This can only be avoided by the high workpiece/die clearance. A problem with this is that it results in a change of the character of the process from the most effective mode of simple shear to bending combined with tension.

Another proposed technique is accumulated roll bonding (ARB). This is described by Y. Saito, N. Tsuji, H. Utsunomiya, T. Sakai, R. G. Hong, in Scripta Mater, 39 (1998) No. 9, 1221-1227. In this a rolled sheet is cut, cleaned, stacked and hot rolled again, as shown in FIG. 4. This sequence is repeated several times until a desired strain is achieved. Because many operations are involved, ARB is not a true continuous process. It is limited by the manageable sheet size. The success of the process depends critically on the quality of the bond, which could be difficult to achieve. The microstructure of metals subjected to ARB is not uniform (a layered structure) and grains are elongated due to rolling.

U.S. Pat. No. 6,197,129 B1 describes another proposal. This is referred to as repetitive corrugation and straightening (RCS). RCS involves bending of a straight plate/bar between corrugated rolls and then restoring the straight shape of the plate/bar with smooth rolls, as shown in FIG. 5. A problem with this process is that it does not use simple shear, and bending leads to non-uniform strain distribution across and along the workpiece.

BRIEF SUMMARY OF VARIOUS EMBODIMENTS OF THE INVENTION

An object of various embodiments of the present invention is to provide an improved continuous severe plastic deformation process.

According to one aspect of the present invention, there is provided a method of treating a metal billet to change its mechanical and/or physical properties by reducing grain size, the method involving forcing the billet through a first passage and into a second passage inclined to the first passage using a feeding mechanism and deforming the billet using a reciprocating die at a junction between the first and second passages.

By using a reciprocating die as the working die, the billet material is subjected to a sequence of loading and unloading. The loading phase deforms the billet plastically to change its structure and properties, whilst the unloading phase reduces the load needed to keep the billet moving from the first to the second passage.

In various embodiments, the method may further involve positioning the reciprocating die away from a constraining position, feeding the billet to an extended position that is beyond the constraining position of the die and moving the reciprocating die back towards its constraining position and into deforming contact with the billet. The steps of positioning, feeding and moving may be repeated. After each incremental feeding step the billet may be restrained in its extended position. The billet may be clamped or supported in position. Alternatively, the billet may be continuously moved through the first passage. The speed of continuous movement of the billet must be synchronised with the reciprocating action of the working die so that billet loading/unloading occurs.

According to another aspect of various embodiments of the present invention, there is provided an apparatus for treating a metal billet to change its mechanical and/or physical properties by reducing grain size, the apparatus having means for defining a first and a second passage, the second passage being consecutive with and inclined to the first passage, a feeding mechanism for feeding the billet through the first and second passages and a reciprocable die at a junction between the first and second passages for causing plastic deformation of the billet. The apparatus may include three or more passages.

The means for defining the first and second passages may be two or more dies. At least one of the dies may be operable to clamp the billet in place.

In particular embodiments, the apparatus may further include means for positioning the reciprocating die away from a constraining position, and means for causing the billet to be fed to an extended position that is beyond the constraining position of the die, wherein the means for positioning the die are operable to move it back towards its constraining position and into deforming contact with the billet.

The working face of the reciprocable die may be flat or profiled, for example, may include a spike to improve the flow of material.

BRIEF DESCRIPTION OF THE DRAWINGS

Various embodiments of the invention will now be described by way of example only and with reference to the accompanying drawings, of which.

DETAILED DESCRIPTION OF VARIOUS EMBODIMENTS OF THE INVENTION

The method in which the invention is embodied involves treating a metal billet to change its mechanical and/or physical properties by reducing grain size by forcing the billet through a first passage and into a second passage consecutive with and inclined to the first passage using a feeding mechanism and deforming the billet using a reciprocating die at a junction between the first and second passages, the reciprocating die being operable to sequentially load and unload the billet.

Figure 1:
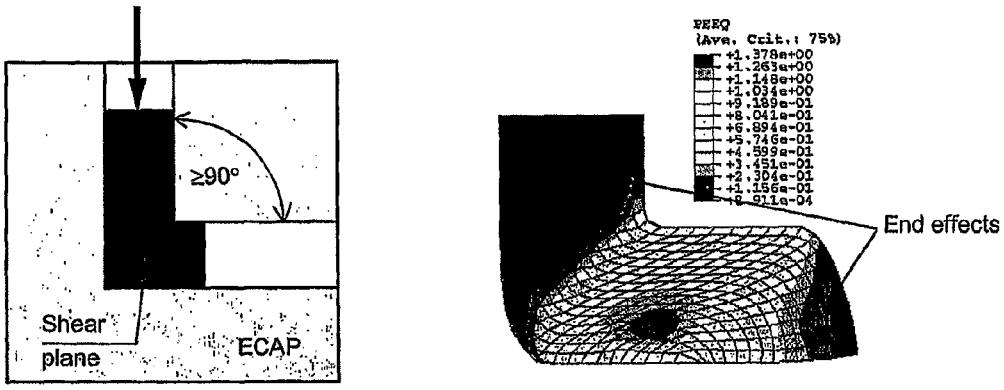
PRIOR ART Figure 1
FIGS. 1-5 illustrate the prior art as discussed above.
Figure 2:
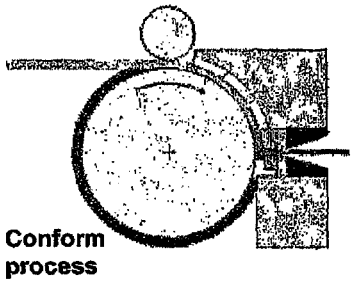
PRIOR ART Figure 2
Figure 3:
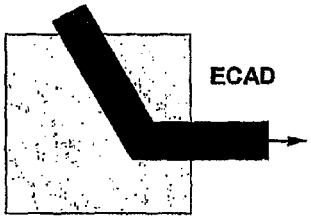
PRIOR ART Figure 3
Figure 4:
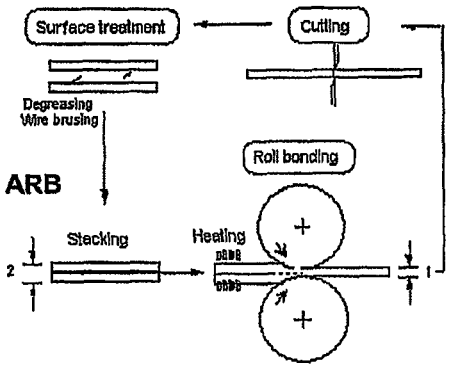
PRIOR ART Figure 4
Figure 5:
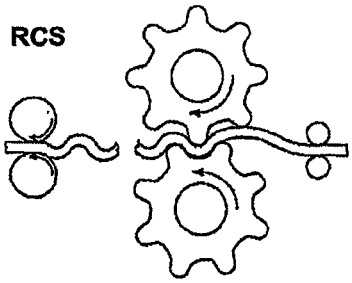
PRIOR ART Figure 5
Figure 6:
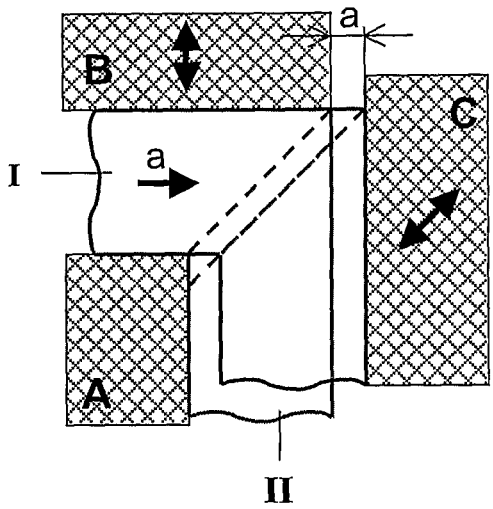
FIG. 6 is cross section of a die arrangement.

The method in which the invention is embodied can be implemented in a number of ways. In a first example, three simple dies, A, B and C are used, as shown in FIG. 6. Die A is fixed, die B is used as a billet holder and die C is a working die, which moves in a reciprocating manner at an appropriate angle to the feeding direction of the billet. Dies A, B and C together define two orthogonal passages that have substantially equal cross-sections. In use, the billet is forced through the passages defined by the dies and the working die C is moved against it so that the billet is sequentially loaded and unloaded. This causes severe plastic deformation of the billet.

To reduce the effort required for feeding the billet through the dies, movement of the working die C is synchronised with an incremental feeding sequence of the billet. The sequence of operations involves moving the dies B and C away from the billet to enable the billet to be moved by a distance "a" so that it sticks out by the same distance beyond the die B. FIG. 6 shows the billet in this position (see part marked I). In these circumstances, where the billet is essentially unloaded, feeding of the billet does not require any substantial force. Then, in this position die B is moved so that it clamps the billet against die A and the working die C is then moved against the end of the billet, thereby loading it and causing it to be plastically deformed in the narrow zone marked by the dashed lines. This causes the billet to assume the form marked II in FIG. 6. The whole sequence described above can be repeated as many times as necessary to process the whole length of the billet, each loading/unloading cycle corresponding to a single feeding cycle. Thus, the process has an incremental and continuous character. In practice, the working stroke of the reciprocating die C and the feeding advance of the billet are arranged to be substantially the same.

Figure 7:
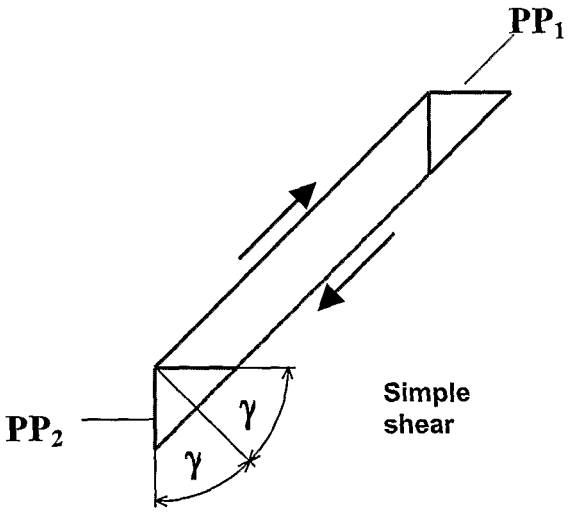
FIG. 7 is an illustration of the shear action that would be applied to a billet that is moved through the die arrangement of FIG. 6.

The geometrical analysis of the material flow in the "dashed" zone leads to the conclusion that the mode of deformation is that of simple shear. For the purpose of analysis this process is split into two steps. Shearing the parallelepiped $PP_1$ of FIG. 7 by the angle $\gamma$ produces a rectangle, for which the shear strain is $tg\gamma$ and the equivalent von Mises strain is $\epsilon=tg\gamma/3^{0.5}$. Continuing this shearing by another angle $\gamma$ converts the rectangle to the parallelepiped marked $PP_2$ and doubles the equivalent strain to $\epsilon=2tg\gamma/3^{0.5}$. For $\gamma=45°$, the total equivalent strain is $\epsilon=1.155$, which is the value known from the classical ECAP with the channel angle of 90°. Thus, in terms of the type and value of the strain produced, the proposed process is equivalent to ECAP. The material flow has to be constrained in a direction perpendicular to the flow plane discussed (plane strain).

Figure 8:
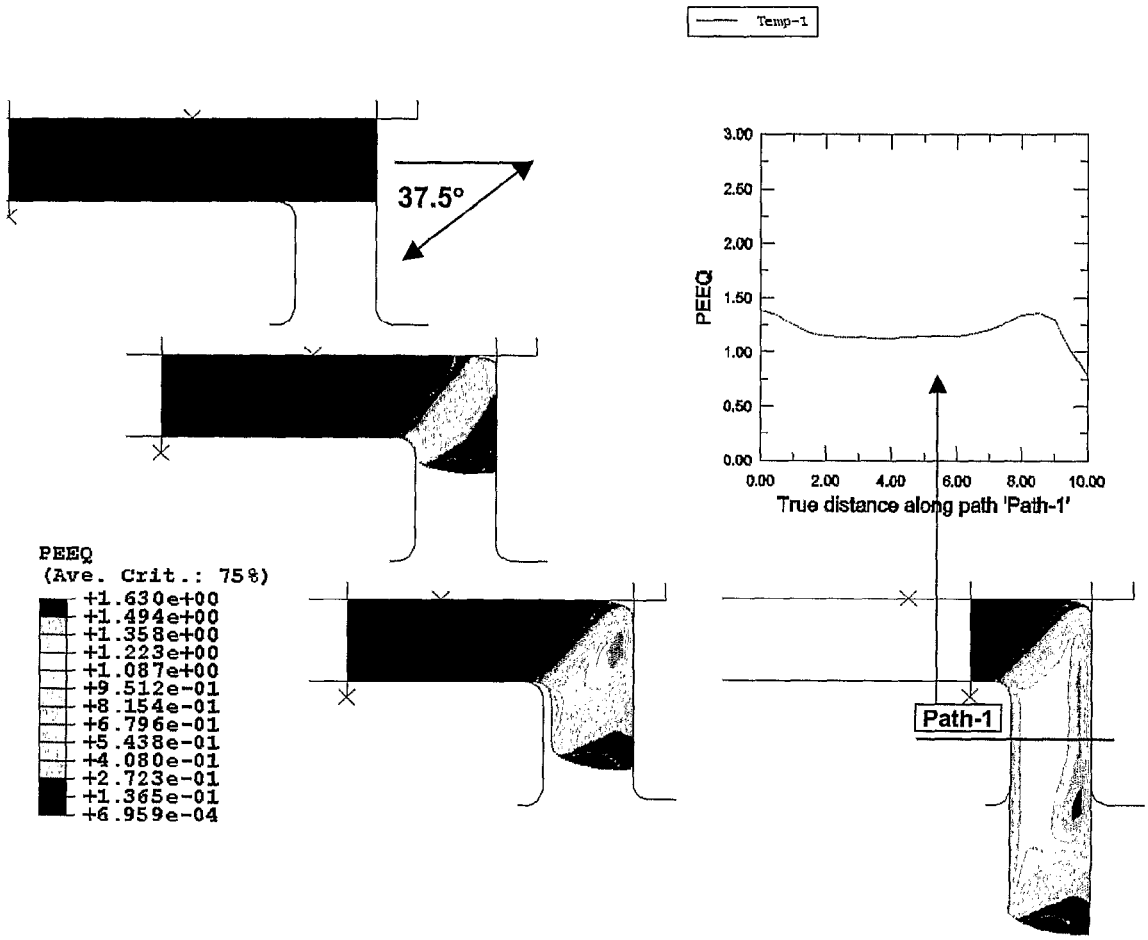
FIG. 8 shows a simulation of the material flow experienced by a billet in the die arrangement of FIG. 6 for a working die acting at an angle of 37.5°.

More detailed analysis of the material flow is possible by using a Finite Element Method (FEM) simulation. FIG. 8 represents the die arrangement illustrated in FIGS. 6 and 7, where only one channel turn is used and the angle between channel passages is 90°. This simulation was carried out to find the best angle for the working die C to achieve a uniform strain distribution in the billet. For a channel that has a thickness of 10 mm, a radius of 2 mm, and a Coulomb friction coefficient $\mu$ of 0.2, the best angle between the feeding direction and the direction of reciprocating movement of the working die was found to be about 37.5°.

Figure 9:
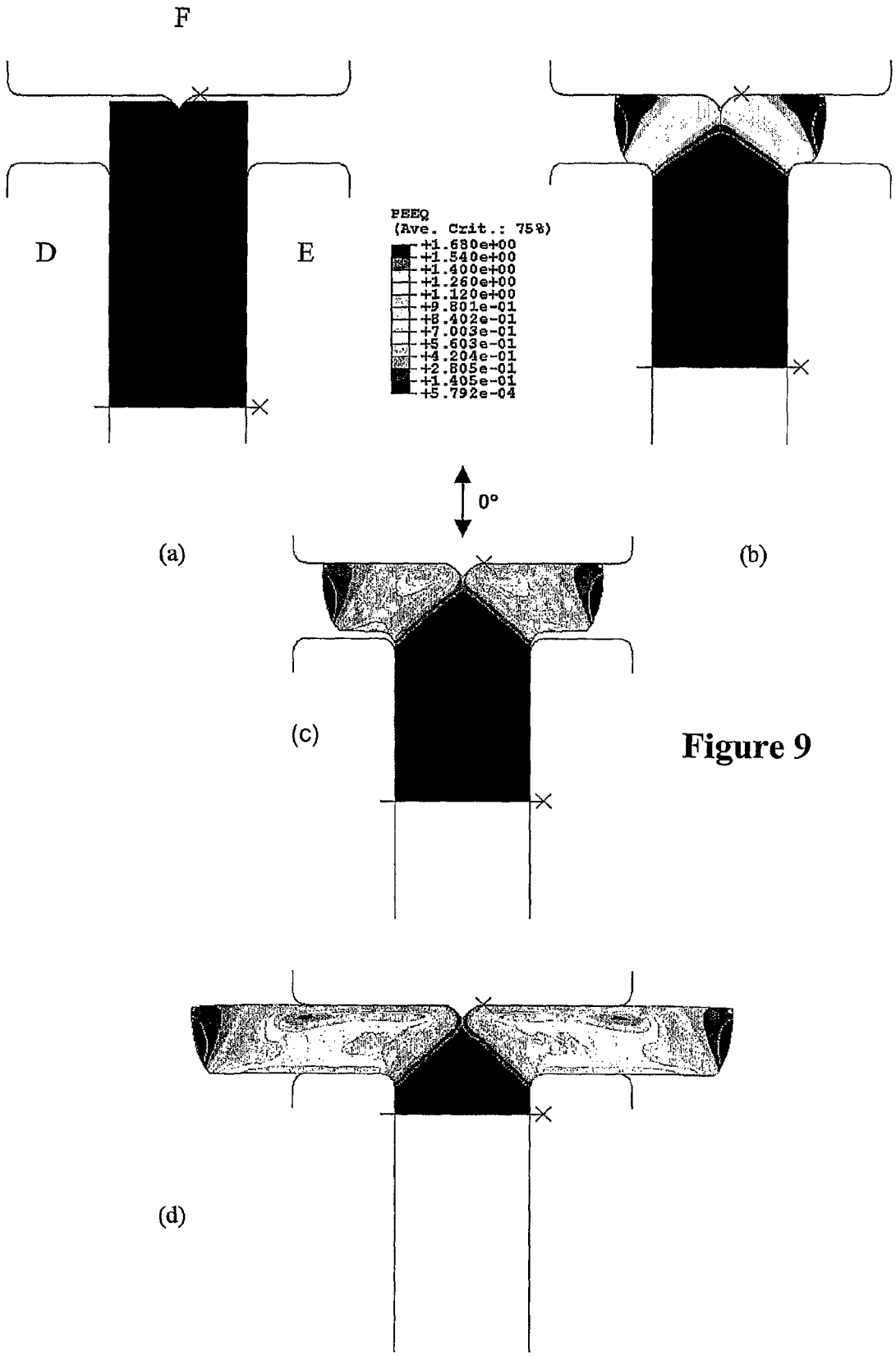
FIG. 9(*a*), (*b*), (*c*), and (*d*) presents simulation results for a two-billet die arrangement and a working die acting at an angle of 0°.

On some machines, an easier option is to have the angle of movement of the working die equal to 0°, so that the feeding direction and die movement direction are the same. FIG. 9 shows an example of this. In this case, three dies are provided, D, E and F. Dies D and E may be fixed (as in this analysis) or arranged to provide a clamping action as described previously. These define a first passage that has a cross-section that is substantially the same as that of two billets. Die F extends across the end of the first passage and is capable of reciprocating movement. Together with dies D and E, die F defines second and third passages, each being orthogonal to the first passage and each having a cross-section that is substantially the same as one of the billets. In a preferred example, the second and third passages have substantially equal cross sections. As will be appreciated, an external feeding mechanism is needed for feeding the billets through the dies. This feeding mechanism could be incremental (as in this analysis) or continuous and typically is arranged so that the feeding advance of the billets is substantially the same as the working stroke of the reciprocating die F. Feeding arrangements are known in the art and so will not be described in detail.

To facilitate material flow, the working die F has a spike at a position that corresponds to the junction between the two dies, thereby to help direct each billet into an appropriate one of the second or third passages. A small chamfer on the leading part of both billets helps initiate the process. Using two billets simultaneously provides a number of practical advantages, including higher productivity, the avoidance of the eccentric force (more important for the channel angle >90°) and tool simplification.

In use, two billets are fed side-by-side into the first passage D, E and moved towards die F, which is in its open, unloading position. This is continued until the billets engage with the working face of die F, see FIG. 9(*a*). At this stage, the position of billets is fixed by clamping or other means. Next, die F starts moving towards the billets, so that the spike pushes into the junction between them. Because of the spike and the continued movement of die F, the billets separate and start deforming by spreading into the second and third passages respectively until die F reaches its closed, loading position, as shown in FIG. 9(*b*). The working die F is then moved away from its closed position. Subsequent unclamping and feeding of the billets in a forward direction causes a gap to form between the lower end of the deformed areas of the billets and the adjacent dies D and E, see FIG. 9(*c*). Then, die F is caused to move towards dies D and E and back to its constraining/loading position, so that each billet is constrained between either dies D and F or dies E and F, thereby causing severe plastic deformation in these areas. Repetition of this sequence results in deformation of nearly the whole length of the billets, as shown in FIG. 9(*d*).

Figure 10:
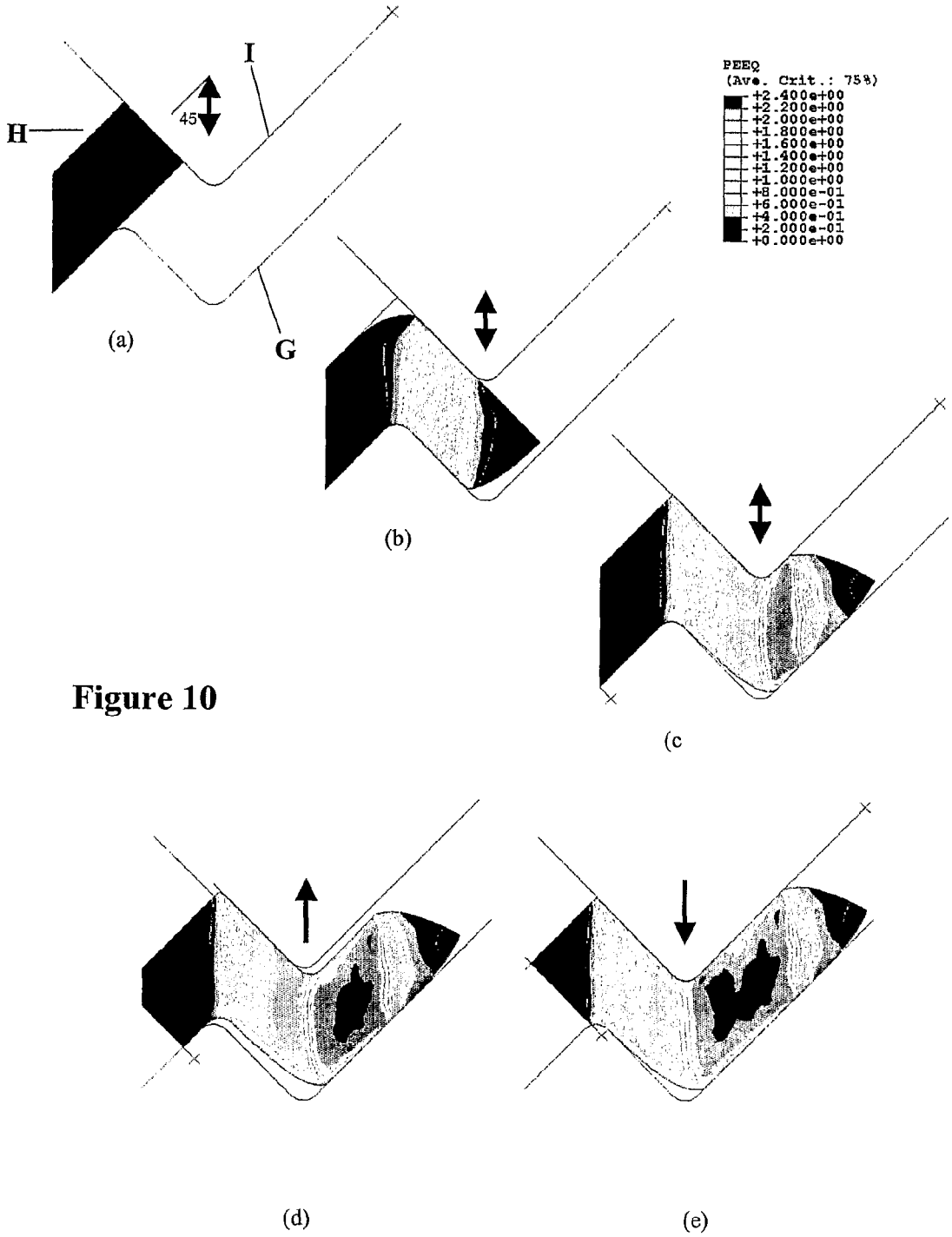
FIG. 10 presents simulation results for a two-turn die arrangement and a working die acting at an angle of 45°.

FIG. 10 shows yet another example of an arrangement for continuous severe plastic deformation of a billet. This is a two-turn die arrangement having two fixed dies G and H and one reciprocable die I. One of the two fixed dies, die G, defines a step having two turning points both defining substantially 90° angles. The reciprocable die I has a substantially right-angled working surface that faces die G. This co-operates with the fixed die H to define a two-turn step having the same shape and size as that of the fixed die G. Dies G and H define a first passage, and dies I and G define second and third orthogonal passages. In this example, the working die I is movable at an angle of 45° to the feeding direction. Whilst dies G and H are described as being fixed, in practice at least one of these could be movable, thereby to provide a clamping mechanism, although this is not essential. As with previous embodiments, to move the billet through the die arrangement of FIG. 10, a feeding mechanism is provided (not shown). This is arranged so that the feeding advance of the billet is substantially the same as the working stroke of the reciprocating die I.

In use of the arrangement of FIG. 10, a billet is fed into the first passage and moved towards die I, which is in its open position. This feeding action is continued until the billet engages with the working face of die I, as shown in FIG. 10(*a*). At this stage, the position of the billet is fixed by clamping or other means. Next, die I starts moving towards the billet and deforms it by causing it to spread round the first turn of die G (by simple shear) and into the second passage until die I reaches its closed position, as shown in FIG. 10(*b*). Withdrawal of die I away from the closed, constraining position enables continuation of billet feeding by a prescribed distance. Repeated feeding and deformation causes the front end of the billet to bear against the second turn of the die G, which in turn causes the billet to deform and start spreading round that second turn and into the third passage. At this stage, the billet extends round both turns in the die arrangement and simple shear type of plastic deformation begins at the junction between the second and third passages, as shown in FIG. 10(*c*). FIG. 10(*d*) shows a more advanced stage of the process where die I is moved away from its constraining position to an open position. Because of the continued forward feeding the billet moves forward with die I to an extended position. FIG. 10(*e*) illustrates the final stage of the process with die I moved back to its closed, constraining position. As will be appreciated, the tooling of FIG. 10 produces two shearing zones and therefore doubles the strain achieved in one pass of the billet ($\epsilon$=2.31).

Figure 11:
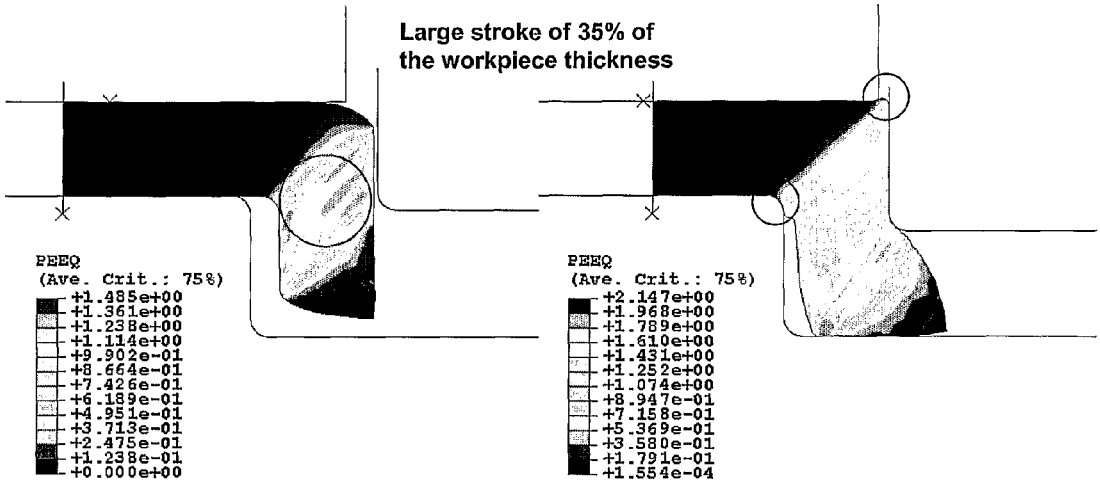
FIG. 11 is a schematic view illustrating the impact of a large stroke.

In all of the above examples, the peak-to-peak amplitude of the reciprocating die movement should not be excessive compared to the thickness of the processed billet, otherwise it causes non-uniform strain distribution, as shown in FIG. 11. According to FEM simulation a safe limit is 10%-20% of the billet thickness.

Since in most practical embodiments, the feeding advance is the same as the working stroke of the reciprocating die, this puts a limit on the average feeding speed. To improve productivity, thin billets could be avoided, parallel processing of billets could be considered and the frequency of the reciprocating movement could be increased. This frequency can be varied as desired depending on the application, and could be in the range of up to ultrasonic frequency, i.e. over 20 kHz.

Figure 12:
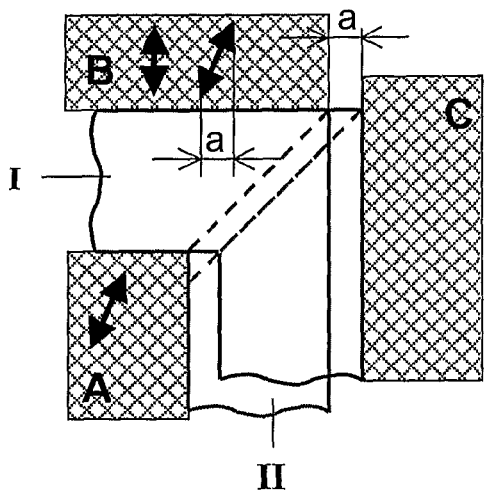
FIG. 12 is a cross section through an alternative die arrangement.

In all of the embodiments described with reference to FIGS. 6 to 11, there is a reciprocating die, which causes loading/unloading of a billet, and a clamping die, which is stationary, except when it is moved to its clamping position. Whilst in these embodiments specific dies are described as either being fixed or reciprocable, it will be appreciated that all movements are relative and in most circumstances it is not important which die or dies move and which are fixed (if any). For example in the dies arrangement illustrated in FIG. 6, dies A/B are fixed and die C is reciprocable. However, die C could be fixed while the dies A/B may be capable of moving in order to load/unload the billet, as shown in FIG. 12. Hence, the sequence of operation could be as follows: die A/B unclamps billet I and moves away from die C by a distance "a". Since the billet I is unclamped, there should be no friction between it and die A/B, although residual friction may require the billet I to be constrained by another means, otherwise the movement of die A/B may drag billet I away from die C. Then die A/B stops moving away from die C and clamps the billet I. Die A/B then moves back towards die C together with the billet I by a distance "a" to deform it to billet II. In this case, there is no relative movement (no friction) between die A/B and billet I.

Figure 13:
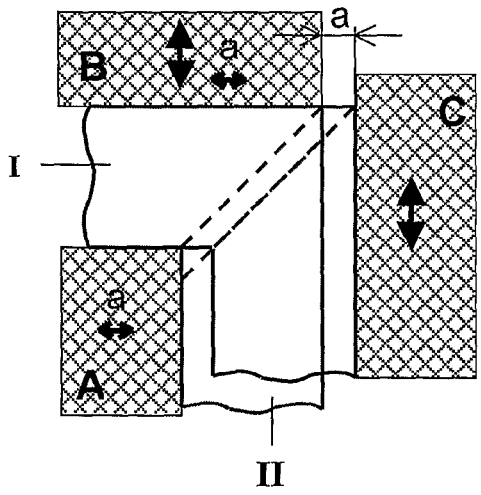
FIG. 13 is a cross section through yet another alternative die arrangement.

FIG. 13 shows another possibility. Here, the die movement is divided between all of the dies A/B and C. As a specific example, die A/B may realise one component of the movement along the first passage, thereby to provide loading and deformation, and die C may realise the other component along the second passage, thereby to reduce friction in that passage.

The present invention provides a substantially continuous severe plastic deformation process that uses interrupted feeding, based on alternative clamping and feeding of the billet, without the material being deformed during the feeding, or substantially continuous feeding, without the material being deformed in at least part of the feeding process. Because the force required for this type of feeding is small or substantially zero, this means that infinitely long billets can be processed. This provides numerous advantages, such as inexpensive tooling and the possibility of using a standard press with an additional feeding/clamping system. In addition, only low forces and tool pressures are needed. Also, because one of the dies is designed to reciprocate, it can be readily moved to provide good access for applying lubricants. Furthermore, provided a suitable feeding rate is used, the strain distribution is highly uniform. There is also no need for a special shape of the leading part of the billet (except chamfering in some cases) and no restrictions on the length, thickness and width of billets. In addition the invention allows for the possibility of parallel processing of long billets and strips/plates. Continuous feeding can also be applied, provided the feeding speed is not excessive compared to the speed of reciprocating die, so that material unloading can be realised, thereby reducing the feeding force.

A skilled person will appreciate that variations of the disclosed arrangements are possible without departing from the invention. For example, although in the drawings, the angle between the channels is shown as 90°, this is not essential. Also, the angle at which the working die "attacks" the material does not need to be 45°—this can be varied for particular applications. In addition, the number of channel turns can be more than one and the working die can be flat as well as profiled. Additionally, although the billet is described as having a rectangular cross section, it could equally be square or round. Also, although in some embodiments the passages are described as having substantially equal cross sections, this is not essential. The leading end of the billet can be flat as well as profiled (chamfered). Furthermore, an excitation signal may be applied to the die to cause it to vibrate, these vibrations being superimposed on the macro-sinusoidal/reciprocating movement of the die. The applied signal may be an ultrasonic signal. Accordingly, the above description of specific embodiments is made by way of example only and not for the purposes of limitations. It will be clear to the skilled person that minor modifications may be made without significant changes to the operation described.

The invention claimed is:

1. A method of treating a metal billet to change its mechanical and/or physical properties by reducing grain size, the method involving feeding the billet through a first passage and into a second passage inclined to the first passage and deforming the billet by repeatedly loading and unloading it using at least one reciprocating die at a junction between the first and second passages, wherein the reciprocating die defines part of the second passage and movement of the reciprocating die in a direction towards the billet loads the billet and movement of the reciprocating die in a direction away from the billet unloads the billet, wherein movement towards and away from the billet, and consequent loading and unloading of the billet, by the reciprocating die is repeated as the billet moves from the first passage to the second passage.

2. A method as claimed in claim 1 comprising restraining the billet during the step of loading.

3. A method as claimed in claim 2 wherein the step of restraining involves clamping the billet.

4. A method as claimed in claim 1 wherein feeding the billet is done in incremental steps.

5. A method as claimed in claim 1 wherein feeding the billet is done continuously.

6. A method as claimed in claim 1 wherein the reciprocating die is operable to reciprocate at a frequency of up to ultrasonic frequencies.

7. A method as claimed in claim 1 involving superimposing a relatively high frequency signal, such as an ultrasonic signal, on the reciprocating die.

8. An apparatus for treating a metal billet to change its mechanical and/or physical properties by reducing grain size, the apparatus having a first passage and a second passage, the second passage being inclined to the first passage, a feeding mechanism for feeding the billet through the first and second passages and at least one reciprocable die for causing plastic deformation of the billet by repeatedly loading and unloading it at a junction between the first and second passages, wherein the reciprocating die defines part of the second passage and movement of the reciprocating die in a direction towards the billet loads the billet and movement of the reciprocating die in a direction away from the billet unloads the billet, wherein movement towards and away from the billet, and consequent loading and unloading of the billet, by the reciprocating die is repeated as the billet moves from the first passage to the second passage.

9. An apparatus as claimed in claim 8 further including means for restraining the billet during loading.

10. An apparatus as claimed in claim 8 wherein the feeding mechanism is operable to incrementally feed the billet.

11. An apparatus as claimed in claim 8 wherein the feeding mechanism is operable to continuously feed the billet.

12. An apparatus as claimed in claim 8 wherein a work face of the reciprocable die is flat.

13. An apparatus as claimed in claim 8 wherein a work face of the reciprocable die is profiled.

14. An apparatus as claimed in claim 13 wherein the work face profile is a spike.

15. An apparatus as claimed in claim 8 including three or more passages.

16. An apparatus as claimed in claim 15 wherein the reciprocating die is operable to load/unload the billet at two or more junctions defined by the three or more passages.

17. An apparatus as claimed in claim 8 wherein means for defining the passages include two or more dies.

18. An apparatus as claimed in claim 17 wherein at least one of the dies is operable to clamp the billet in place.

19. An apparatus as claimed in claim 8 wherein the passages all have a cross section that is equal or substantially equal.

20. An apparatus as claimed in claim 8 wherein the first passage is adapted to receive two or more billets.

21. An apparatus as claimed in claim 8 including means for superimposing a relatively high frequency signal, such as an ultrasonic signal, on the reciprocating die.

* * * * *